US006608023B2

(12) United States Patent
Klaers et al.

(10) Patent No.: US 6,608,023 B2
(45) Date of Patent: Aug. 19, 2003

(54) SOLID POT AND PAN DETERGENT

(75) Inventors: Karen G. Klaers, Eagan, MN (US); Helen B. Bailly, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/068,144

(22) Filed: Feb. 6, 2002

(65) Prior Publication Data

US 2002/0107164 A1 Aug. 8, 2002

Related U.S. Application Data

(62) Division of application No. 09/282,001, filed on Mar. 29, 1999, now Pat. No. 6,387,870.

(51) Int. Cl.[7] ..... C11D 1/22; C11D 7/06; C11D 17/00

(52) U.S. Cl. ..... 510/495; 510/224; 510/225; 510/298; 510/445; 510/446; 510/447; 510/451; 510/457

(58) Field of Search ..... 510/224, 225, 510/298, 445, 446, 447, 451, 457, 495

(56) References Cited

U.S. PATENT DOCUMENTS

| | | | | |
|---|---|---|---|---|
| 2,220,099 | A | * 11/1940 | Guenther et al. | 260/505 |
| 2,477,383 | A | * 7/1949 | Lewis | 252/161 |
| 3,048,548 | A | 8/1962 | Martin et al. | 510/231 |
| 3,334,147 | A | 8/1967 | Brunelle et al. | 568/611 |
| 3,695,989 | A | 10/1972 | Albert | 428/69 |
| 3,954,660 | A | 5/1976 | Kennedy et al. | 510/200 |
| 4,133,779 | A | 1/1979 | Hellyer et al. | 510/365 |
| 4,235,758 | A | 11/1980 | Dawson et al. | 510/429 |
| 4,289,815 | A | 9/1981 | Lee | 428/35.4 |
| 4,348,293 | A | 9/1982 | Clarke et al. | 510/296 |
| 4,416,793 | A | 11/1983 | Barrat et al. | 510/335 |
| 4,426,362 | A | 1/1984 | Copeland et al. | 422/263 |
| 4,435,317 | A | 3/1984 | Gerritsen et al. | 510/235 |
| 4,474,976 | A | 10/1984 | Faltynek | 556/481 |
| 4,595,520 | A | 6/1986 | Heile et al. | 510/380 |
| 4,608,187 | A | 8/1986 | Chang | 510/296 |
| 4,680,134 | A | 7/1987 | Heile et al. | 510/379 |
| 4,681,704 | A | 7/1987 | Bernardino et al. | 510/365 |
| 4,687,121 | A | 8/1987 | Copeland | 222/64 |
| 4,690,305 | A | 9/1987 | Copeland | 222/52 |
| 4,692,494 | A | 9/1987 | Sonenstein | 525/57 |
| 4,608,187 | A | 2/1988 | Chang | 510/296 |
| RE32,763 | E | 10/1988 | Fernholtz et al. | 252/90 |
| RE32,818 | E | 1/1989 | Fernholz et al. | 252/90 |
| 4,826,661 | A | 5/1989 | Copeland et al. | 422/106 |
| 4,861,518 | A | 8/1989 | Morganson et al. | 510/214 |
| 4,923,635 | A | 5/1990 | Simion et al. | 510/365 |
| 4,933,100 | A | 6/1990 | Ramachandran | 510/298 |
| 5,019,346 | A | 5/1991 | Richter et al. | 422/28 |
| 5,061,392 | A | 10/1991 | Bruegge et al. | 510/404 |
| 5,062,986 | A | 11/1991 | Fujita et al. | 510/152 |
| 5,064,554 | A | 11/1991 | Jacobs et al. | 510/225 |
| 5,078,301 | A | 1/1992 | Gladfelter et al. | 222/52 |
| 5,096,622 | A | 3/1992 | Simion et al. | 422/264 |
| 5,198,198 | A | 3/1993 | Gladfelter et al. | 510/439 |
| 5,234,615 | A | 8/1993 | Gladfelter et al. | 372/34 |
| 5,243,719 | A | 9/1993 | McDonald et al. | 4/665 |
| 5,262,079 | A | 11/1993 | Kacher et al. | 510/146 |
| 5,316,688 | A | 5/1994 | Gladfelter et al. | 510/224 |
| 5,376,310 | A | 12/1994 | Cripe et al. | 510/235 |
| 5,397,506 | A | 3/1995 | Groth et al. | 252/547 |
| 5,436,008 | A | 7/1995 | Richter et al. | 424/405 |
| 5,474,698 | A | 12/1995 | Rolando et al. | 252/90 |
| 5,474,710 | A | 12/1995 | Ofosu-Asanta et al. | 510/537 |
| 5,527,489 | A | * 6/1996 | Tadsen et al. | 252/174 |
| 5,571,459 | A | 11/1996 | Thomas et al. | 510/365 |
| 5,580,849 | A | 12/1996 | Dyet et al. | 510/427 |
| 5,599,400 | A | 2/1997 | Mao et al. | 134/25.2 |
| 5,604,195 | A | 2/1997 | Misselyn et al. | 510/400 |

(List continued on next page.)

FOREIGN PATENT DOCUMENTS

| | | |
|---|---|---|
| EP | 0 340 589 A1 | 11/1989 |
| EP | 0 673 993 A2 | 5/1994 |
| GB | 2 144 763 A | 3/1985 |
| WO | WO 92/06156 | 4/1992 |
| WO | WO 92/06157 | 4/1992 |
| WO | WO 92/20774 | 11/1992 |
| WO | WO 97/28241 | 8/1997 |
| WO | WO 97/33962 | 9/1997 |
| WO | WO 98/14559 | 4/1998 |

OTHER PUBLICATIONS

"Chelating Agents", *Kirk–Othmer Encyclopedia of Chemical Technology—Castor Oil to Chlorosulfuric Acid*, 3rd Ed., vol. 5, pp. 339–366. (1996).

"Emulsions", *Kirk–Othmer Encyclopedia of Chemical Technology—Diuretics to Emulsions*, 3rd Ed., vol. 8, pp. 900–912. (1997).

"Extraction Solvents and Reagents" and "Selectedd Sorbents", *Kirk–Othmer Encyclopedia of Chemical Technology—Thyroid and Antithyroid Preparations to Vinyl Polymers*, 3rd Ed., vol. 23, pp. 319–320. (1998).

*Primary Examiner*—Gregory DelCotto
(74) *Attorney, Agent, or Firm*—Merchant & Gould P.C.

(57) ABSTRACT

A solid block detergent composition is described which can be dispensed with a water spray to form an aqueous detergent for cutting and removing grease, removing and suspending soils and rinsing easily leaving cleaned ware. The aqueous detergent concentrate can be used in a cleaning liquid having exceptional soil, particularly grease removing properties with stable foam properties. The solid block detergent contains a package of surfactants including a neutralized anionic surfactant with either one or a mixture of an alkali and alkaline earth metal salt thereof and an alkylpolyglycoside. The active ingredients and polyethylene glycol as a hardening agent are dispersed in a matrix which hardens to form a solid block.

17 Claims, No Drawings

U.S. PATENT DOCUMENTS

| | | | | |
|---|---|---|---|---|
| 5,616,781 | A | | 4/1997 | Sajic et al. ..... 510/221 |
| 5,635,466 | A | | 6/1997 | Burdon et al. ..... 510/341 |
| 5,637,758 | A | | 6/1997 | Sajic et al. ..... 560/147 |
| 5,641,742 | A | | 6/1997 | Adamy et al. ..... 510/500 |
| 5,646,104 | A | | 7/1997 | Erilli et al. ..... 510/365 |
| 5,677,436 | A | | 10/1997 | Desai et al. ..... 536/4.1 |
| 5,686,400 | A | | 11/1997 | Urfer et al. ..... 510/237 |
| 5,693,605 | A | | 12/1997 | Isobe et al. ..... 510/499 |
| 5,696,071 | A | | 12/1997 | Okutsu et al. ..... 510/126 |
| 5,700,772 | A | | 12/1997 | Isobe et al. ..... 510/421 |
| 5,801,137 | A | | 9/1998 | Addison et al. ..... 510/228 |
| 5,952,289 | A | * | 9/1999 | Wise et al. ..... 510/450 |
| 5,968,892 | A | * | 10/1999 | Hutchins ..... 510/447 |
| 6,172,026 | B1 | * | 1/2001 | Ospinal et al. ..... 510/355 |

* cited by examiner

SOLID POT AND PAN DETERGENT

This application is a divisional of application Ser. No. 09/282,001, filed Mar. 29, 1999, now U.S. Pat. No. 6,387, 870, which application is incorporated herein by reference.

FIELD OF THE INVENTION

The application relates to solid detergent materials. Largely, the invention relates to a solid detergent composition containing a detergent formulation dispersed in an organic solidification matrix. The combination of ingredients provides excellent soil removal, improved grease cutting and controlled foaming in an aqueous detergent composition made from the solid.

BACKGROUND OF THE INVENTION

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pellet forms of detergents, including improved handling, enhanced safety, elimination of component segregation during transportation and storage, and increased concentrations of active components within the composition. Because of these benefits, solid block cleaning compositions, such as those disclosed in Fernholz, et al., U.S. Pat. Nos. Re 32,763, 32,818, 4,680,134 and 4,595,520, have quickly replaced the conventional composition forms in commercial and institutional markets. Another sodium hydroxide and sodium carbonate cast solid process using substantially hydrated sodium materials was disclosed in Heile et al. U.S. Pat. Nos. 4,595,520 and 4,680,134. Further, pelletized materials are shown in Gladfelter et al., U.S. Pat. Nos. 5,078,301, 5,198,198 and 5,234, 615. Extruded materials are disclosed in Gladfelter et al., U.S. Pat. No. 5,316,688. The solid block format is a safe, convenient and efficient product format.

Various hardening mechanisms have been used in cleaning and sanitizing compositions for converting a fluid composition to a solid mass for containment and modification of the solubility of the active ingredients during use. For example, the active ingredients may be combined with the hardening agent under melting temperatures, commonly referred to as a "molten process," to achieve a homogeneous mixture, wherein the melt is then poured into a mold and cooled to a solid form.

U.S. Pat. No. 5,019,346 to Richter, for example, discloses a solid block drain treatment product formed by heating a mixture containing a chemical sanitizer and a hardening agent such as urea or an alkyl amide such as stearic monoethanolamide or stearic diethanolamide, and decanting the melt into containers. Morganson, U.S. Pat. No. 4,861, 518, discloses a solid cleaning concentrate formed by heating an anionic or nonionic surfactant system with a hardening agent such as polyethylene glycol, at about 130–150° F. (54 to 66° C.) to form a melt. The melt is combined with other ingredients including a solubilizer and an alkali, to form a homogeneous mixture, and the molten mixture then poured into a capsule container to cure or harden. U.S. Pat. Nos. 4,595,520 and 4,680,134 to Heile et al. disclose a solid alkaline detergent formed from an aqueous emulsion containing a sodium condensed phosphate hardness sequestering agent and an alkaline builder salt such as sodium hydroxide, which is solidified by incorporating a hydratable hardening agent such as an anhydrous sodium carbonate and/or sodium sulfate. Preferably, the emulsion is heated to form a molten mass, and then cooled to effect solidification. U.S. Pat. No. 5,064,554 to Jacobs et al. discloses a solid detergent in the form of a fused block manufactured by preparing a melt of alkaline metal silicate, alkali metal hydroxide, optionally water, an active chlorine donor and/or an organic complexing agent, combining the melt with a penta-alkali metal triphosphate, introducing the melt into a flow mixer, and pouring the molten mixture into a mold to solidify.

Solid block cleaning and sanitizing compositions and rinse aids provide a significant improvement over the conventional liquid, granular and pelletized cleaning compositions. Although the molten process is useful for preparing solid block compositions, time and expense would be saved if heating and cooling of the composition could be minimized or eliminated from the process, and higher viscosities could be used. Also, lower process temperatures would better facilitate the use of heat-sensitive ingredients in cleaning compositions. In addition, less sturdy packaging would be required if the processed mixture could be packaged at a lower temperature. Furthermore, eliminating molten temperatures would avoid swelling and deformation of the solid product.

Various attempts have been made to manufacture cleaning compositions by an extrusion process. U.S. Pat. No. 5,061, 392 to Bruegge et al., for example, discloses a method of forming a detergent composition having a paste-like consistency, by combining a first aqueous solution containing a potassium tripolyphosphate and a second aqueous solution containing a water-soluble, sodium-based detergent builder, namely sodium hydroxide. Upon mixing, the viscosity of the mixture rapidly increases to form a highly viscous paste. In another extrusion method, as disclosed in U.S. Pat. No. 4,933,100 to Ramachandran, an organic detergent of particulate or patty form is formed by kneading together a synthetic organic detergent, a hydratable builder salt such as sodium tripolyphosphate, and water. The mixture is passed through an extruder and forced through openings at or slightly above room temperature and a low pressure to form a rod-shaped extrudate. A disadvantage of these processes is that a caustic, hydratable alkaline source is required to facilitate hardening of the processed composition after extrusion.

Richter. U.S. Pat. Nos. 5,436,008, 5,243,719 and others generally teach the use of polyethylene glycol materials as a component of a hardened composition.

The prior art shows a variety of liquid detergent compositions. Exemplary disclosures include Kennedy et al., U.S. Pat. No. 3,954,660 which disclose a slurry comprising a surfactant package and other components in a flowable mixture. Hellyer et al., U.S. Pat. No. 4,133,779 teach a liquid detergent composition comprising a semipolar nonionic detergent and an alkali metal salt of an anionic detergent useful in cleaning methods. Thomas et al., U.S. Pat. No. 5,571,459 teach a liquid emulsion that has a surfactant package that can include a magnesium salt of an anionic sulfate such as lauryl sulfate. Sajic et al., U.S. Pat. Nos. 5,616,781 and 5,637,758 teach liquid detergent compositions comprising a critical amount of a divalent cation and a minimum amount of an alpha-sulfonated methyl ester of a fatty acid, anionic surfactants and foam stabilizers in a pourable flowable mixture. Burdon et al., U.S. Pat. No. 5,635,466 disclose a concentrated aqueous surfactant solution comprising a magnesium salt of an alkyl ether sulfate. The material can take the form of a magnesium salt or a mixed magnesium ammonium salt. Similar liquid or granular detergent compositions are shown in Rolfes et al., WO 92/06156; Faber, EP 673 993; Herbots et al., GB 2 144 763; and Fu et al. WO 92/06157. Dawson et al., U.S. Pat. No. 4,235,758; Bernardino et al. U.S. Pat. No. 4,681,704; Simion et al., U.S. Pat. Nos. 4,923,635 and 5,096,622: disclose pourable stable clear liquid detergent compositions containing ingredients including both magnesium salts of anionic materials and sodium salts of anionic materials.

Gerritsen et al., U.S. Pat. No. 4,435,317 teach a stable liquid detergent composition containing a surfactant package comprising a magnesium or magnesium ammonium salt of anionic materials.

Misselyn et al., U.S. Pat. No. 5,604,195 disclose a liquid pourable cleaning composition that has a surfactant package and a small amount of either a polyvinyl pyrrolidone or a polyethylene glycol which polymeric materials are used at an amount of less than about 10% as grease release agents. The Misselyn et al. liquid materials can also contain magnesium salts.

Fujita et al. U.S. Pat. No. 5,062,986 and Kacher et al., U.S. Pat. No. 5,262,079 disclose soap bars. Fujita et al. use a water soluble polyester polymer material to solidify typical soap formulations. Kacher et al. utilize a mixed metal salt of a free monocarboxylic acid comprising 35 to 80 wt % of the mixture to form a solidified soap bar.

Cripe et al., U.S. Pat. No. 5,376,310; Ofsu-Asanta et al., U.S. Pat. No. 5,474,710; and Mao et al., U.S. Pat. No. 5,599,400 teach light duty liquid or gel materials comprising a surfactant package and magnesium salts of anionic materials.

Aqueous cleaning compositions have commonly been used in applications including hospital, household, institutional and industrial services, hand and body soaps. laundry soaps, warewashing and housekeeping surfaces. Typically, these cleaning materials are made by diluting liquid or gelled materials to form a use solution. Many such solutions have had some success in the past, however, a substantial need in this art exists to manufacture an easily used concentrate having minimal water and a high actives concentration, excellent soil, e.g. grease, removal properties and controlled foaming. Many prior art materials even in a concentrate form contain substantial amounts of water which is difficult to manufacture, transport and sell. The materials also may have some soil removal properties but improving grease removal and hard surface cleaners is a continuing need or requirement. Further, the manufacture of materials that produce useful foam in the presence of large quantities of greasy soil is a continuing challenge for this marketplace.

SUMMARY OF THE INVENTION

We have found that many of the needs can be met by forming a solid block detergent composition with high active content, minimal water content having the active ingredients dispersed in a hardening agent, e.g. polyethylene glycol (PEG), to form a solidification matrix. We have found that the useful active materials can include an anionic surfactant wherein the surfactant is neutralized with an alkali metal, an alkaline earth metal species, or, preferably, a mixture thereof. The neutralized anionic can be beneficially combined with a surfactant or surfactant package which includes an alkylpolyglycoside as one of the surfactants. In the manufacture of the solid block detergent composition, some surfactants and at least a part of the solidification matrix are blended at elevated temperatures. The anionic material is neutralized using an alkali metal and/or an alkaline earth metal base. The material is mixed until uniform and then combined with the balance of the ingredients. The warm liquid material is placed in a suitable container for solidification. Upon reaching ambient temperatures, the material hardens into a water soluble and dispersible solid block. For the purpose of this application, the term "solid" is different from a gel. Gels typically are a suspension of a solid material in a typically aqueous liquid material that at appropriate percentages form a thickened material or gelled material and have a measurable viscosity but no measurable penetrometer value (hardness). The materials of the present invention are solids in that they have a distinct solid character, have a measurable penetrometer value and melt at elevated temperatures. Preferred solids have a penetrometer value between about 3 and about 80; the lower the penetrometer value, the harder the solid block material. The solid block materials do not rely on a gelling mechanism in which water combines with solid materials to form a gel.

Accordingly, the invention is found in a detergent composition containing an effective detersive amount of a neutralized anionic surfactant; an alkali metal, an alkaline earth metal salt or a mixture thereof; an effective detersive amount of an alkyl polyglycoside surfactant; an effective detersive amount of a nonionic surfactant, an amphoteric surfactant or salt thereof, or a mixture thereof; and about 1 to 75 wt-% of a hardening agent, preferably about 3 to 75 wt-% of a polyethylene glycol; wherein the above components are dispersed to form a matrix which hardens to a solid block.

The invention is also found in a detergent composition which contains about 1 to 95 wt-% of a neutralized anionic surfactant including a mixed alkali metal alkaline earth metal salt of an organic sulfonate, an organic sulfate surfactant or mixture of such surfactants, an effective amount of an alkali or alkaline earth metal or mixture thereof; about 0.1 to 15 wt % of an alkyl polyglycoside; about 1 to 30 wt % of a nonionic foam stabilizing surfactant; and optionally about 0.1 to 10 wt % of an amphoteric surfactant.

The invention is further found in a solid block detergent composition as above defined which, when diluted with water, forms an aqueous detergent with stable foam and improved greasy soil removing capacity. The solid block detergent is useful in cleaning pots and pans, especially in manually washing pots and pans.

DETAILED DESCRIPTION OF THE INVENTION

The solid block compositions are produced using a batch or continuous mixing system, preferably a single- or twin-screw extruder, by combining and mixing one or more cleaning agents and a hardening agent at high shear to form a homogeneous mixture. Preferably, the processing temperature is at or below the melting temperature of the ingredients. Optionally, but preferably, the cleaning agent is combined with one or more additive ingredients. The processed mixture may be dispensed from the mixer by extruding, casting or other suitable means, whereupon the composition hardens to a solid form which ranges in consistency from a solid block to a malleable, spongy, self-supporting form, such as a coil, square or other shape. Variations in processing parameters may be used to control the development of crystal size and crystalline structure of the matrix and thus the texture of the final product. For example, continuing to shear the mixture while solidification is in progress will create a smaller crystal and a pasty product. The structure of the matrix may be characterized according to hardness, melting point, material distribution, crystal structure, and other like properties according to known methods in the art. A cleaning composition processed according to the method of the invention is substantially homogeneous with regard to the distribution of ingredients throughout its mass, and is also substantially deformation-free.

The solid block detergents of the invention contain a package of surfactants including a neutralized anionic surfactant, either one or a mix of an alkali and alkaline earth metal salt and an alkylpolyglycoside. Nonionic and/or amphoteric surfactants may also form part of the package. The solid block detergent can be dispensed with a water spray to form an aqueous detergent for cutting and removing grease, removing and suspending soils and rinsing easily leaving cleaned ware. The aqueous detergent concentrate can be used in a cleaning liquid having exceptional soil, particularly grease removing properties with stable foam properties. The active ingredients and hardening agents, e.g. polyethylene glycol, are dispersed in a matrix which hardens to form a solid block.

Unless otherwise specified, the term "wt-%" is the weight of an ingredient based upon the total weight of the composition.

Cleaning Agents

The composition includes at least one cleaning agent which is a surfactant or surfactant system. This surfactant package has anionic surfactants, an alkyl polyglycoside and either a nonionic surfactant, an amphoteric surfactant or a mixture thereof. For a discussion of surfactants, see Kirk-Othmer, *Encyclopedia of Chemical Technology*, Third Edition, volume 8, pages 900–912.

Anionic Surfactants

Anionic surfactants useful in the present cleaning compositions include, for example, sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like. Preferred anionics include an organic sulfonate surfactant or an organic sulfate surfactant. More preferred anionics include an alkylsulfonate, alkylarylsulfonate, sulfonated fatty acid ester, sulfated alcohol, sulfated alcohol ethoxylate, sulfated alkylphenol, alkyl sulfate, dialkylsulfosuccinate, alkylethersulfate, and mixtures thereof.

In the invention, the anionic surfactant(s) may be neutralized with an alkali metal salt and/or an alkaline earth salt or a mixture thereof. Preferably, a mixture of salts is used, and the alkali metal is sodium and the alkaline earth metal is magnesium. Preferably, the molar ratio of sodium to magnesium is from about 3:1 to 1:1, and, most preferably, the molar ratio of sodium to magnesium is about 2:1. Without wishing to be limited by theory, it is believed that the sodium cation serves to enhance solubility of the surfactant in water while the magnesium cation enhances solubility in oil.

Nonionic Surfactants

Nonionic surfactants useful in the present detergent compositions may include those having a polyalkylene oxide polymer as a portion of the surfactant molecule. Such nonionic surfactants include, for example, alcohol alkoxylates such as alcohol ethoxylate propoxylates, alcohol propoxylates, alcohol propoxylate ethyoxylate propoxylates, alcohol ethoxylate butoxylates, and the like, and alkyl-capped alcohol alkoxylates; polyoxyethylene glycol ethers of fatty alcohols such as CETEARETH®-27 or PARETH® 25-7, and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds.

Preferably, the nonionic surfactant used is a polyhydroxy fatty acid amide. More preferably, the nonionic surfactant employed may be lauric monethanol amide. cocomonethanol amide, or a mixture thereof.

Alkyl Polyglycoside Surfactants

Alkyl polyglycosides are unusual in that they offer a hydrophilic portion which is based on sugar chemistry. The chemical structure is shown below, in which m generally ranges from 6 to 14 and n averages 1 or 2.

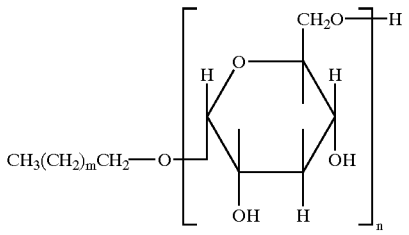

These surfactants have not been widely used to date due to a poor cost-performance profile. However, we have found that the use of such surfactants in the present solid block detergent composition provides benefits such as reducing skin irritation from the other surfactants, increasing foam stability and improving grease removal. The composition of the invention requires an alkyl polyglycoside which is preferably lauryl polyglycoside.

Amphoteric Surfactants

Also useful are amphoteric surfactants such as β-N-alkylaminopropionic acids, N-Alkyl-β-iminodipropionic acids, imidazoline carboxylates, N-alkylbetaines, sultaines, and the like. A preferred amphoteric surfactant is cocoamidopropylbetaine.

Aqueous Medium

The ingredients of the composition may be processed in a minor but effective amount of an aqueous medium such as water, to provide an effective level of viscosity for processing the mixture, and to provide the processed composition with the desired amount of firmness and cohesion during solid block formation and upon hardening. The mixture during processing may include about 0.01 to 15 wt-% of an aqueous medium, preferably about 0.1 to 10%t-%. The composition upon being discharged from the mixer may contain about 0.01 to 15 wt-% of an aqueous medium, preferably about 0.1 to 5 wt-%.

Hardening Agent

A hardening agent, as used in the present method and compositions, is a compound or system of compounds, organic or inorganic, that significantly contributes to the uniform solidification of the composition. Preferably, the hardening agents are compatible with the cleaning agent and other active ingredients of the composition, and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid composition during use.

The amount of hardening agent included in the cleaning composition will vary according to the type of cleaning composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of about 30 to 50° C., preferably about 35 to 45° C., after mixing ceases and the mixture is dispensed from the mixing system, within about 1 minute to about 3 hours, preferably about 2 minutes to about 2 hours, preferably about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use.

The preferred organic hardening agent is a polyethylene glycol (PEG) compound for use in the above cleaning composition. The solidification rate of cleaning compositions comprising a polyethylene glycol hardening agent made according to the invention will vary, at least in part, according to the amount and the molecular weight of the polyethylene glycol added to the composition.

Polyethylene glycol compounds useful according to the invention include, for example, solid polyethylene glycols of the general formula $H(OCH_2—CH_2)_nOH$, where n is greater than 15, more preferably about 30 to 1700. Solid polyethylene glycols which are useful are commercially available from Union Carbide under the name CARBOWAX. Typically, the polyethylene glycol is a solid in the form of a free-flowing powder or flakes, having a molecular weight of about 1000 to 100,000, preferably having a molecular weight of at least about 1450 to 20,000, more preferably between about 1450 to about 8000. The polyethylene glycol is present at a concentration of from about 1 to 75 wt-%, preferably about 3 to 15 wt-%. Suitable polyethylene glycol compounds useful according to the invention include, for example, PEG 1450 and PEG 8000 among others, with PEG 8000 being most preferred.

Preferred inorganic hardening agents are hydratable inorganic salts, such as sulfates, acetates, carbonates, and bicarbonates. The inorganic hardening agents are present at concentrations of about 0 to 50 wt-%, preferably about 5–25 wt-%, more preferably about 5–15 wt-%.

Additive Agents

The cleaning compositions may further include conventional detergent adjuvants such as a sequestering agent, bleaching agent, alkaline source, enzyme, secondary hardening agent, detergent filler, defoamer, anti-redeposition agent, a threshold agent or system, aesthetic enhancing agent (i.e., dye, perfume), and other like additives. Adjuvants and other additive ingredients will vary according to the type of composition being manufactured.

Chelating/Sequestering Agents

The composition may include a chelating/sequestering agent such as an aminocarboxylic acid, a condensed phosphate, a phosphonate, a polyacry-late, and the like. In general, a chelating agent is a molecule capable of coordinating (i.e., binding) the metal ions commonly found in natural water to prevent the metal ions from interfering with the action of the other detersive ingredients of a cleaning composition. Depending on the type of cleaning composition being formulated, a chelating/sequestering agent is included in an amount of about 0.1 to 70 wt-%, preferably from about 5 to 50 wt-%.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like. Examples of condensed phosphates useful in the present composition include, for example, sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as aminotris(methylene phosphonic acid), hydroxyethylidene diphosphonic acid, ethylenediaminetetra(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching Agents

Bleaching agents that may be used in a cleaning composition for lightening or whitening a substrate, include bleaching compounds capable of liberating an active halogen species, such as —Cl, —Br, —OCI and/or —Obr, under conditions typically encountered during the cleansing process. Suitable bleaching agents for use in the present cleaning compositions include, for example, chlorine-containing compounds such as a chlorine, hypochlorite, chloramine, and the like. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,618,914, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1 to 10 wt-%, preferably about 1 to 6 wt-%.

Alkaline Sources

The cleaning composition produced according to the invention may include minor but effective amounts of one or more alkaline sources to neutralize the anionic surfactants and improve soil removal performance of the composition. Accordingly, an alkali metal or alkaline earth metal hydroxide or other hydratable alkaline source, is preferably included in the cleaning composition in an amount effective to neutralize the anionic surfactant. However, it can be appreciated that an alkali metal hydroxide or other alkaline source can assist to a limited extent, in solidification of the composition. Although the amount of alkali metal and alkaline earth metal hydroxide is necessitated to neutralize the anionic surfactant as above described, additional alkaline sources may be present to a point where the pH of an aqueous solution does not exceed 9.

Suitable alkali metal hydroxides include, for example, sodium or potassium hydroxide. Suitable alkaline earth metal hydroxides include, for example, magnesium hydroxide. An alkali or alkaline earth metal hydroxide may be added to the composition in the form of solid beads, dissolved in an aqueous solution, or a combination thereof. Alkali and alkaline earth metal hydroxides are commercially available as a solid in the form of prilled beads having a mix of particle sizes ranging from about 12–100 U.S. mesh, or as an aqueous solution, as for example, as a 50 wt-% and a 73 wt-% solution. It is preferred that the alkali or alkaline earth metal hydroxide is added in the form of an aqueous solution, preferably a 50 wt-% hydroxide solution, to reduce the amount of heat generated in the composition due to hydration of the solid alkali material.

A cleaning composition may include a secondary alkaline source other than an alkali metal hydroxide. Examples of secondary alkaline sources include a metal silicate such as sodium or potassium silicate or metasilicate, a metal carbonate such as sodium or potassium carbonate, bicarbonate or sesquicarbonate, and the like; a metal borate such as sodium or potassium borate, and the like; ethanolamines and amines; and other like alkaline sources. Secondary alkalinity agents are commonly available in either aqueous or powdered form, either of which is useful in formulating the present cleaning compositions.

Detergent Fillers

A cleaning composition may include a minor but effective amount of one or more of a detergent filler, which does not perform as a cleaning agent per se, but cooperates with the cleaning agent to enhance the overall cleaning action of the composition. Examples of fillers suitable for use in the present cleaning compositions include sodium sulfate, sodium chloride, starch, sugars, and $C_1$–$C_{10}$ alkylene glycols such as propylene glycol, and the like. Preferably, the filler is included in an amount of about 1 to 20 wt-%, preferably about 3 to 15 wt-%.

Defoaming Agents

A minor but effective amount of a defoaming agent for reducing aeration during processing may also be included in a cleaning composition. Preferably, the cleaning composition includes about 0.0001 to 5 wt-% of a defoaming agent, preferably about 0.01 to 1 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found in U.S. Pat. No. 3,048,548 to Martin et al., U.S. Pat. No. 3,334,147 to Bruneile et al., and U.S. Pat. No. 3,442,242 to Rue et al., the disclosures of both references incorporated by reference herein.

Anti-Redeposition Agents

A cleaning composition may also include an anti-redeposition agent capable of facilitating sustained suspension of soils in a cleaning solution and preventing removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, carboxymethyl cellulose, and the like. A cleaning composition may include about 0.5 to 10 wt-%, preferably about 1 to 5 wt-%, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.). Acid Orange 7 (American Cyanamid), Basic Violet 10 (Sandoz). Acid Yellow 23 (GAF), Acid Yellow 17 (Sigma Chemical Co.), Fluorescein (Capitol Color and Chemical), Rhodamine (D&C Red No. 19), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as CIS-jasmine or jasmal, vanillin, and the like.

Processing of the Composition

The invention provides a method of processing non-caustic cleaning compositions at lower temperatures and higher viscosities than are typically used when processing the same or similar composition by other methods such as a molten process.

Although not intended to limit the scope of the invention, it is believed that, at least in part, the continuous mixing of the ingredients of the cleaning composition at high shear enables the composition to be processed at a significantly lower temperature than that needed in other processing methods by which the ingredients of the composition are melted to form a homogeneous mixture. It is also believed that the continuous mixing of the ingredients enables the amount of the hardening agent required for effective hardening of a composition to be substantially reduced from that typically needed for preparing the corresponding cleaning compound by a molten process or other known method.

The mixing system provides for continuous mixing of the ingredients at high shear to form a substantially homogeneous semi-solid mixture in which the ingredients are distributed throughout the mass. The mixing system includes means for mixing the ingredients and to provide shear effective for maintaining the mixture at a flowable consistency such that the mixture can be stirred, mixed, agitated, blended, poured. extruded, and/or molded in conventional industrial mixing and/or shearing equipment of the type suitable for continuous processing and uniform distribution of ingredients in a mixture. Preferably, the viscosity of the mixture during processing is about 1,000 to 1,000,000 cps (about 1 to 1,000 Pa·s), more preferably about 5,000 to 200,000 cps (about 5 to 200 Pa·s). The mixing system is preferably a continuous flow mixer, as for example, a Teledyne continuous processor, a Beardsley Piper continuous mixer, more preferably a single- or twin-screw extruder, with a twin-screw extruder being highly preferred, as for example, a multiple section Buhler Miag twin-screw extruder.

Generally, the mixture is processed at a temperature lower than the melting temperature of the ingredients of the composition, preferably about 1 to 90° C. lower, preferably about 5 to 20° C. lower. Although minimal or no external heat may be applied to the mixture during processing, it can be appreciated that the temperature achieved by the mixture may become elevated during processing due to variances in processing conditions, and/or by an exothermic reaction between ingredients. Optionally, the temperature of the mixture may be increased, for example at the inlets or outlets of the mixing system, by applying heat from an external source to achieve a temperature of about 50 to 150° C., preferably about 55 to 70° C., to facilitate processing of the mixture.

In general, the composition is processed at a pressure of about 5 to 150 psig (about 34 to 1034 kPa), preferably about 10 to 30 psig (about 70 to 210 kPa). The pressure may be increased up to about 30 to 6000 psig (about 210 kPa to 41 MPa) to maintain fluidity of the mixture during processing, to provide a force effective to urge the mixture through the mixer and discharge port, and the like.

An ingredient may be in the form of a liquid or solid such as a dry particulate, and may be added to the mixture separately or as part of a premix with one or more other ingredient, as for example, the cleaning agent, aqueous medium, and additional ingredients such as a second cleaning agent, a detergent adjuvant or other additive, a hardening agent, and the like. One or more premixes may be added to the mixture.

An aqueous medium may be included in the mixture as desired, in a minor but effective amount to maintain the mixture at a desired viscosity during processing, and to provide the processed composition and final product with the desired amount of firmness and cohesion during discharge and hardening. The aqueous medium may be included in the mixture as a separate ingredient, or as part of a liquid ingredient or premix.

The ingredients are mixed together at high shear to form a substantially homogenous consistency wherein the ingredients are distributed substantially evenly throughout the mass. The mixture is then discharged from the mixing system by casting into a mold or other container or by extruding the mixture. Preferably, the mixture is cast or extruded into a mold or other packaging system, that can optionally, but preferably, be used as a dispenser for the composition. It is preferred that the temperature of the mixture when discharged from the mixing system is sufficiently low to enable the mixture to be cast or extruded directly into a packaging system without first cooling the mixture. Preferably, the mixture at the point of discharge is at about ambient temperature, about 30 to 50° C. preferably about 35 to 45° C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel rotating screws designed to co-rotate and intermesh, the extruder having multiple barrel sections and a discharge port through which the mixture is extruded. The extruder may include, for example, one or more feed or conveying sections for receiving and moving the ingredients, a compression section, mixing sections with varying temperature, pressure and shear, a die section, and the like. Suitable twin-screw extruders can be obtained commercially and include for example, Buhler Miag Model No. 62 mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout.

The extruder has a high shear screw configuration and screw conditions such as pitch, flight (forward or reverse) and speed effective to achieve high shear processing of the ingredients to a homogenous mixture. Preferably, the screw includes a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20 to 300 rpm, more preferably about 40 to 150 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing including at the discharge port, is maintained at or below the melting temperature of the ingredients, preferably at about 50 to 200° C.

In the extruder, the action of the rotating screw or screws will mix the ingredients and force the mixture through the sections of the extruder with considerable pressure. Pressure may be increased up to about 6,000 psig (about 41 MPa), preferably up to about 5 to 150 psig (about 34 to 1034 kPa), in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is complete, the mixture may be discharged from the extruder through the discharge port, preferably a die. The pressure may also be increased at the discharge port to facilitate extrusion of the mixture, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from a few minutes to about 2 to 3 hours, depending, for example, on the size of the cast or extruded composition, the ingredients of the composition, the temperature of the composition, and other like factors. Preferably, the cast or extruded composition "sets up" or begins to harden to a solid form within 30 seconds to about 3 hours, more preferably within about 1 minute to about 2 hours and most preferably within about 1 minute to about 1 hour.

Packaging System

The processed compositions of the invention may be cast or extruded into temporary molds from which the solidified compositions may be removed and transferred for packaging. The compositions may also be cast or extruded directly into a packaging receptacle. Extruded material may also be cut to a desired size and packaged, or stored and packaged at a later time.

The packaging receptacle or container may be rigid or flexible, and composed of any material suitable for containing the compositions produced according to the invention, as for example, glass, steel, plastic, cardboard, cardboard composites, paper, and the like. A preferred receptacle is a container made of a polyolefin such as polyethylene.

Advantageously, since the composition is processed at or near ambient temperatures, the temperature of the processed mixture is low enough so that the mixture may be cast or extruded directly into the container or other packaging receptacle without structurally damaging the receptacle material. As a result, a wider variety of materials may be used to manufacture the container than those used for compositions that processed and dispensed under molten conditions.

It is highly preferred that the packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang; U.S. Pat. No. 4,416,793 to Haq; U.S. Pat. No. 4,348,293 to Clarke; U.S. Pat. No. 4,289,815 to Lee: and U.S. Pat. No. 3,695,989 to Albert, the disclosures of which are incorporated by reference herein.

In addition, the mixture may be cast into a variety of shapes and sizes by extrusion since the viscosity of the mixture can be varied, for example, according to the amount of shear applied during mixing, the amount of hardening agent and water in the composition ingredients, temperature of the mixture, and other like factors. Also, unlike the "molten process." since the mixture is processed at a relatively low temperature, minimal cooling of the composition is required prior to or after casting or extruding. The low temperature of the discharged material also enhances safety for those handling the material. In addition, the extruded or cast composition will harden substantially simultaneously throughout its mass when the mixture is discharged from the mixing system due to cooling and/or the chemical reaction of the ingredients of the composition, with or without a hardening agent.

Dispensing of the Processed Compositions

It is preferred that a solid block cleaning composition made according to the present invention is dispensed from a spray-type dispenser such as those disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

Compositions

The table below gives useful, preferred and more preferred composition ranges for each essential ingredient in the invention:

| Component | Useful (wt-%) | Preferred (wt-%) | More Preferred (wt-%) |
|---|---|---|---|
| anionic surfactant | 1–70 | 15–70 | 35–65 |
| alkyl polyglycoside surfactant | 0.1–15 | 2–12 | 5–10 |
| nonionic surfactant | 1–30 | 5–20 | 5–15 |
| amphoteric surfactant* | 0–30 | 5–15 | — |
| polyethylene glycol | 3–75 | 3–35 | 3–15 |

*Optional

The invention is illustrated further by, but is not intended to be limited to, the following examples.

General Method of Preparation

The formulations described below were generally prepared by mixing the ingredients in a high shear mixer, preferably an extruder, as described here:

The high melt point solids, amides and polyethylene glycol, are melted in a tank. Then the liquid surfactant, sodium or magnesium laurel ether sulfate, is added followed by fragrance and dye. The premix is then held at 15 to 30° F. (8 to 17° C.) above its melt point. The solid surfactants, other solid ingredients and the liquid premix are simultaneously metered into the extruder. The product exits the extruder as a solid and is cut and transported to the packaging equipment.

Manual Foam Height Test Method

Purpose:

To screen hand dish washing detergents for foam height and stability.

| Apparatus/Equipment/Reagents: | |
|---|---|
| Shortening | Guwina-Hofmann rotation device |
| Flour | Ground glass stoppered graduated bylinders (250 ml) |
| Powdered egg | Rubber stoppers |
| Oleic Acid | Hot plate with variable heat adjustments |
| Disposable pipettes | Water bath/heat chamber |

Equipment Setup:

Calibrate the Guwina-Hofmann rotation device to 30 rpm.

Procedure:

Forty milliliters of the aqueous test solution is placed in a 250 ml stoppered graduated cylinder and warmed to 110° F. (about 43° C.). The cylinder is rotated for 4 minutes by a Guwina-Hofmann rotation device and an initial foam height is measured in ml gradients. Two drops (approximately 0.05 g) of a liquefied soil containing 45% shortening, 30% flour, 15% powdered egg and 10% oleic acid is added to the test solution, which is rotated for two minutes. This step is repeated until 45 ml or less foam results. The initial foam height, and the foam height after each addition of soil are summed to obtain a total foam height for the test. Each test is performed in triplicate, with an average foam height used to judge performance.

Grease Removal Test Procedure

Purpose:

To screen a detergent's ability to remove grease.

| Materials: | |
|---|---|
| corn oil | hydrogenated soybean oil |
| glycerol stearate | Automatic pipette |
| 2 liter Pyrex bottles | 1000 ml polypropylene breakers |
| Speed control for mixer | Lightning mixer |
| Tachometer | Standard agitator blade |
| Top loading balance | 250–500 ml glass beaker |
| Magnet stir bar | Heated magnetic stirrer (temp controlled) |
| Constant temperature bath/ heating chamber | Thermometer, digital readout preferred |

Equipment Setup:

1. The lightning rod mixers need to be calibrated to 210 rpm. The rpm are determined with a digital readout tachometer.
2. The blade of the mixer should be centered on the 250 ml line of the beaker.

Calculations:

$$\% \text{ Removal} = \frac{\text{Soil Removed} \times 100}{\text{Total Soil}}$$

Procedure:

Fifteen grams of clarified soil containing 82% corn oil, 13.5% hydrogenated soybean oil and 4.5% glycerol stearate is heated to 160° F. (about 71° C.) and is applied to 1000 ml polypropylene beakers which are then immersed in an ice bath. The soil solidifies and is held in the bath for five minutes. The soiled beaker is then stored at room temperature for 24 hours before performing the soil removal test. A test solution (500 ml) is heated to 110° F. (about 43° C.) and is added to a soiled beaker with constant stirring for 15 minutes. The beaker is drained, held overnight in an inverted position and is reweighed. Data recorded includes the hardness of the water used to make test solutions, the pH of the test solutions and the weight of soil removed. A commercially available hand dish washing detergent can be used a control.

EXAMPLE 1

Note that these formulations may also contain minor amounts of dyes and fragrances. Such materials do not significantly affect the properties of the formulation and therefore are excluded from these composition tables.

| Raw Material | Formula 1 % | Formula 2 % | Formula 3 % | Formula 4 % | Formula 5 % | Formula 6 % | Formula 7 % | Formula 8 % |
|---|---|---|---|---|---|---|---|---|
| Formulations | | | | | | | | |
| polyethylene glycol 20 M | 12 | 11 | 13 | 12 | 10 | | | |
| polyethylene glycol 8000 | 12 | 11 | 13 | 12 | 10 | 30 | 25 | 20 |
| linear dodecyl benzene sulfonic acid | 28 | 28 | 28 | 28 | 28 | 28 | 30 | 32 |
| antifoam 544 | 0.02 | 0.02 | 0.02 | 0.02 | 0.02 | 0.02 | 0.02 | 0.02 |
| NaOH - 50% | 4 | 4 | 4 | 4 | 4 | 4 | 5 | 5 |
| Mg(OH)2 | 3 | 3 | 2 | 2 | 2 | 2 | 3 | 3 |
| lauryl polyglucoside | 8 | 8 | 8 | 8 | 8 | 8 | 9 | 10 |
| cocoamidopropyl betaine | 12 | 12 | 12 | 12 | 12 | 10 | 11 | 12 |
| sodium lauryl ether sulfate | 16 | 18 | 14 | 14 | 18 | 13 | 14 | 15 |
| lauric monoethanolamide | 3 | 3 | 5 | 7 | 7 | 3 | 4 | 4 |
| pH = | 8.1 | 8 | 7.8 | 7.8 | 7.1 | 7.8 | 7.80 | 8.20 |
| Penetrometer[1] outside | 87 | 87 | 79 | 101 | 224 | 61 | 126 | |
| Penetrometer inside | 88 | 102 | 94 | 112 | 251 | 65 | 156 | |

[1]Penetrometer manufactured by Precision Scientific Petroleum Instruments.

EXAMPLE 2

Foam Performance

These same formulations were tested to determine their ability to retain foam. Note that while high molecular weight PEGs work well as solidification agents, the presence of PEGs of greater than 8000 molecular weight tend to substantially hinder foam performance. Each formulation is tested three times, with the averages recorded here.

| Product | Concentration (oz/gal) | Temperature (° F.) | Average Foam Height (ml) |
|---|---|---|---|
| Solid Pantastic Control | 1 oz/10 | 110 | 489 |
| Formula 1 | 1.08 oz/10 | 110 | 373 |
| Formula 2 | 1.05 oz/10 | 110 | 396 |
| Formula 3 | 1.07 oz/10 | 110 | 363 |
| Formula 4 | 1.04 oz/10 | 110 | 306 |
| Eormula 5 | 1.02 oz/10 | 110 | 383 |
| Formula 6 | 1.12 oz/10 | 110 | 462 |

The following table compares Formula 6 made as both a liquid and a solid. Liquid formulations were used to facilitate testing, while the data in this table shows no significant difference between the liquid and solid formulations. Each average foam height given shows an average of three runs.

| Product | Concentration (oz/gal) | Temperature (° F.) | Average Foam Height (ml) |
|---|---|---|---|
| Liquid Formulations | | | |
| Solid Pantastic Control | 1 oz/10 | 110 | 496 |
| Formula 6 | 1.14 oz/10 | 110 | 465 |
| Formula 6 | 1.14 oz/10 | 110 | 408 |
| Formula 6 | 1 oz/10 | 110 | 388 |
| Formula 6 | 1 oz/10 | 110 | 406 |
| Formula 6 re-run | 1 oz/10 | 110 | 367 |
| Formula 6 re-run | 1.14 oz/10 | 110 | 452 |
| Solid Formulations | | | |
| Solid Pantastic Control | 1 oz/10 | 110 | 506 |
| Solid Pantastic Control | 1 oz/15 | 110 | 367 |
| Solid Pantastic Control | 1 oz/20 | 110 | 344 |
| Formula 6 | 1.14 oz/10 | 110 | 503 |

-continued

| Product | Concentration (oz/gal) | Temperature (° F.) | Average Foam Height (ml) |
|---|---|---|---|
| Formula 6 | 1.14 oz/15 | 110 | 371 |
| Formula 6 | 1.14 oz/20 | 110 | 304 |

EXAMPLE 3

Salt Ratios

These formulations were used to determine the effects of changing the salts used; particularly, changing the molar ratio between magnesium and sodium.

| Raw Material | Formula 9 % | Formula 10 % | Formula 11 % |
|---|---|---|---|
| polyethylene glycol 20M | 11 | 11 | 11 |
| polyethylene glycol 8000 | 11 | 11 | 11 |
| linear dodecyl benzene sulfonic acid | 32 | 32 | 32 |
| antifoam 544 | minor | minor | minor |
| NaOH-50% | 7 | | 4 |
| Mg(OH)2 | | 5 | 3 |
| lauryl polyglucoside | 10 | 10 | 10 |
| cocoamidopropyl betaine | 12 | 12 | 12 |
| sodium lauryl ether sulfate | 15 | 15 | 15 |
| lauric monoethanolamide | 4 | 4 | 4 |
| rating | soft | soft | hard |

EXAMPLE 4

Affect of Salt Ratios on Foam

These results show that an excess of magnesium (beyond a 1:1 molar ratio) substantially decreases foam performance. Note that the $Mg(OH)_2$ has a dual purpose: it must neutralize the LAS acid as well as supplying the necessary Mg. The average foam height is based on the average of three runs.

| Product | Concentration (oz/gal) | Temperature (° F.) | Average Foam Height (ml) |
|---|---|---|---|
| Solid Pantastic Control | 1 oz/10 gal | 110 | 506 |
| Formula 9 (all NaOH) | 1 oz/10 gal | 110 | 422 |
| Formula 10 (Mg(OH)) | 1 oz/10 gal | 110 | 182 |
| Formula 11 (Na/Mg mix) | 1 oz/10 gal | 110 | 256 |

EXAMPLE 5

Affect of Salt Ratios on Grease Removal

If the Mg:Na molar ratio drops below 1:1, grease removal efficacy is substantially reduced.

| Product | Concentration | Average* Percent Removed |
|---|---|---|
| Solid Pantastic Std | 1 oz/10 gal | 27.19 |
| Formula 9 (all NaOH) | 1 oz/10 gal | 0.29 |
| Formula 10 (Mg(OH)) | 1 oz/10 gal | 2.60 |
| Formula 11 (Na/Mg mix) | 1 oz/10 gal | 26.02 |

*Average of three runs.

EXAMPLE 6

Various Surfactants

These formulations were used to evaluate various surfactant combinations. Note that the use of amphoteric surfactants serve to boost foam stability while simultaneously enhancing grease removal. Liquid compositions were used to expedite the screening process in order to avoid the time consuming work of extruding solid compositions.

| Raw Material | Formula 36 % | Formula 37 % | Formula 38 % | Formula 39 % | Formula 40 % | Formula 41 % | Formula 42 % |
|---|---|---|---|---|---|---|---|
| Water | 43 | 43 | 43 | 43 | 43 | 43 | 43 |
| MgO | 1 | 1 | 1 | 1 | 1 | 1 | 1 |
| linear dodecyl benzene sulfonic acid | 22 | 22 | 22 | 22 | 22 | 22 | 22 |
| NaOH - 50% | 3 | .3 | 3 | 3 | 3 | 3 | 3 |
| lauric monoethanolamide | 3 | 3 | 3 | 3 | 3 | 3 | 3 |
| coco monoethanolamide | 13 | 13 | 13 | 13 | 13 | 13 | 13 |
| sodium lauryl ether sulfate | 10 | 10 | 10 | 10 | 10 | 10 | 10 |
| lauroamophoacetate | 8 | | | | | | |
| capryloamphoproprionate | | 5 | | | | | |
| capryloamphodiproprionate | | | 7 | | | | |
| cocoamidopropyl betaine | | | | 8 | | | |
| coco monoethanolamide | | | | | | 2 | 5 |
| disodium cocoamphodiproprionate | | | | | 4 | | |

Once optimal formulations were developed, solid formulations were created by replacing the coco amidopropyl betaine with coco monoethanolamide, replacing the linear dodecyl benzene sulfonic acid liquid with a solid flake, and by adding polyethylene glycol 8000.

Preferred solid formulations are shown in the table below:

| Raw Material | Preferred (wt-%) | More Preferred (wt-%) | Most Preferred (wt-%) |
|---|---|---|---|
| polyethylene glycol 8000 | 20 | 3 | 3 |
| linear dodecyl benzene sulfonic acid flake | 38 | 46 | 38 |
| lauryl polyglucoside | 4 | 5 | 10 |
| antifoam 544 | minor | minor | minor |
| coco monoethanolamide | 4 | 4 | 4 |
| 70% lauryl ether sulfate (sodium salt) | 13 | 16 | 15 |
| lauric monoethanolamide | 4 | 5 | 4 |
| sodium acetate | 10 | 12 | 12 |
| $MgSO_4.7H_2O$ | 6 | 8 | 13 |
| Nylosan Violet F-BL 180 | minor | minor | minor |
| fragrance | minor | minor | minor |

EXAMPLE 7

Grease Removal

| Formula | Concentration | pH | Avg % |
|---|---|---|---|
| 36 | 2.95% | 7.5 | 20.42 |
| 37 | 2.96% | 7.3 | 29.71 |
| 38 | 2.95% | 7.6 | 33.27 |
| 39 | 2.96% | 7.3 | 34.67 |
| 40 | 3.01% | 7.7 | 26.89 |
| 41 | 2.96% | 7.3 | 36.18 |
| 42 | 2.80% | 7.6 | 36.11 |

EXAMPLE 8

The following formulations were prepared as described in their respective patents and resulted in gels having no measurable hardness.

Summary

| Patent Number | Example | Formula | Specific Gravity | Viscosity* (cps) |
|---|---|---|---|---|
| 5,376,310 | 1 | B | 1.0248 | 146, Spindle #1, 50 rpm |
| 5,376,310 | 2 | B | 1.0480 | 242, Spindle #1, 50 rpm |
| 5,474,710 | 3 | G | 1.0422 | 92, Spindle #1, 50 rpm |
| 5,599,400 | 5 | N | 1.0228 | 78, Spindle #1, 50 rpm |
| 5,604,195 | 2 | | 1.0432 | 47, Spindle #1, 50 rpm |

*Measured with a Brookfield viscometer.

Test Formulation (Present Invention)

| Component | Concentration (Wt %) |
|---|---|
| linear dodecyl benzene sulfonic acid flake | 44.92 |
| sodium acetate | 12.00 |
| magnesium acetate | 9.42 |
| lauryl polyglucoside | 5.23 |

-continued

| Component | Concentration (Wt %) |
|---|---|
| polyethylene glycol 8000 | 2.91 |
| lauric monoethanolamide | 5.23 |
| antifoam | 0.02 |
| coco monoethanolamide | 4.17 |
| sodium lauryl ether sulfate | 15.7 |
| yellow dye | 0.01 |
| fragrance | 0.39 |

This formulation resulted in a penetrometer reading of 11.

U.S. Pat. No. 5,604,195, Example 2

Addition of PEG 600 w/out Solidification

| Patent Ingredient | Tested Ingredient | Wt % |
|---|---|---|
| Sodium ($C_{13}$–$C_{17}$) alkyl sulfonate | linear dodecyl benzene sulfonic acid | 12.0 |
| Diethylene glycol monobutyl ether | Dow glycol ether | 8.4 |
| PEG 600 | sample | 4.0 |
| perfume | Sozio | 2.4 |
| $MgSO_4.7H_2O$ | | 4.5 |
| Fatty alcohol ($C_{13}$–$C_{15}$) 7EO, 4PO | Henkle or BASF | 7.2 |
| Fatty acid | Coco fatty acid | 1.5 |
| Water | | 60.0 |

U.S. Pat. No. 5,376,310-Example 1, Formulation B

Excellent grease cutting, most mild formula, gel form

| Patent Ingredient | Tested Ingredient | Wt % |
|---|---|---|
| Na ($C_{12}$–$C_{13}$) alkyl ethoxy (3.5 aye) carboxyl | Sandolan 15-24 | 22.0 |
| $C_{12}$–$C_{13}$alkyl ethoxy (3.5 ave) alcohol | Neodol 23-3 | 1.30 |
| Na ($C_{12}$–$C_{13}$) alkyl sulfate | SLS powder | 6.0 |
| $C_{12}$–$C_{14}$ alkyl amidopropyl dimethyl betaine | Costec | 3.0 |
| $C_{12}$–$C_{14}$–$C_{16}$ alkyl dimethyl amine oxide | Barlox 12 | 3.0 |
| $MgC_{12}$ .6H2O | | 0.60 |
| Diethanol amine | coco monoethanol-amide | 5.0 |
| Bicine (N.N-Bis(2-hydroxy ethyl) glycine | sample | 5.0 |
| Ethanol | lab | 9.0 |
| Perfume & dye | Sozio | 0.15 |
| Water | | 44.95 |

U.S. Pat. No. 5,376,310-Example II, Formulation B Excellent grease cutting, most mild formula, gel form

| Patent Ingredient | Tested Ingredient | Wt % |
|---|---|---|
| Na ($C_{12}$–$C_{13}$) alkyl ethoxy (3.5 ave) carboxyl | Sandolan 15-24 | 22.0 |
| $C_{12}$–$C_{13}$alkyl ethoxy (3.5 ave) alcohol | Neodol 23-3 | 1.35 |
| Na ($C_{12}$–$C_{13}$) alkyl sulfate | SLS powder | 6.0 |
| $C_{12}$–$C_{14}$ alkyl amidopropyl dimethyl betaine | Costec | 3.0 |
| $C_{12}$–$C_{14}$–$C_{16}$ alkyl dimethyl amine oxide | Barlox 12 | 3.0 |
| $MgC_{12}$.6H2O | | 0.6 |
| 2-Amino-2-ethyl-1,3-propanediol | AMP 95 vender | 6.0 |

-continued

| Patent Ingredient | Tested Ingredient | Wt % |
|---|---|---|
| Citric acid | Lab | 2.0 |
| Water/misc | | 56.05 |

U.S. Pat. No. 5,474,710-Example III, Formulation G
Use of $Mg(OH)_2$ for neutralization

| Patent Ingredient | Tested Ingredient | Wt % |
|---|---|---|
| Na ($C_{12}$–$C_{13}$) alkyl ethoxy (1 ave) sulfate | SLES special - Stepan | 31.0 |
| Na ($C_{12}$–$C_{13}$) alkyl ethoxy (3 ave) sulfate | 70% SLES | 8.0 |
| Amine Oxide | Barlox 12 | 2.0 |
| $C_{12}$ alkyl N-methyl glucamide and $MgC_{12}$ | Henle-Ecolab | 9.0 |
| $MgC_{12}$.7H2O | Lab | 0.9 |
| Perfume | Sozio | 0.9 |
| Sucrose | Lab | 2.0 |
| Citric acid | Lab | 0.05 |
| Sodium toluene sulfonate | A&W | 3.0 |
| Ethanol | Lab | 5.5 |
| Water | | 37.65 |

U.S. Pat. No. 5,599,400-Example V, Formulation N
Gel Formulation

| Patent Ingredient | Tested Ingredient | Wt % |
|---|---|---|
| Diethylenetriamine penta acetate | Victor | 0.06 |
| Ethanol | Lab | 9.15 |
| Mg(OH) | Lab | 2.18 |
| Sucrose | Reg sugar | 1.5 |
| Alkyl ethoxy (1) sulfate | SLES special | 34.14 |
| NaOH | Lab | 1.13 |
| Polyhydroxy fatty acid amide | Glucamide | 6.5 |
| Amine oxide | Barlox 12 | 3.0 |
| Cocoamidopropyl betaine | Costec | 2.0 |
| Perfume | Sozio | 0.23 |
| Alkyl diphenyl oxide disulfonate | Dowfax 3B1 | 2.3 |
| Calcium fornate | Formic acid & ca + | 1.14 |
| Water | | 36.67 |

EXAMPLE 9

The following formulas illustrate typical extrudable compositions.

| Raw Material | Formula 36 % | Formula 37 % | Formula 38 % | Formula 39 % | Formula 40 % | Formula 41 % | Formula 42 % | Formula 43 % | Formula 44 % | Formula 45 % |
|---|---|---|---|---|---|---|---|---|---|---|
| polyethylene glycol 8000 | 3 | 3 | 3 | 3 | 3 | 3 | 3 | 3 | 3 | 3 |
| linear dodecyl benzene sulfonic acid flake | 48 | 46 | 49 | 50 | 50 | 46 | 447 | 48 | 46 | 47 |
| linear dodecyl benzene sulfonic acid | | | | | | 8 | | | | |
| Mg(OH)2 | | | | | | 1.907 | | | | |
| lauryl polyglucoside | 6 | 5 | 6 | 6 | 6 | 5 | 5 | 6 | 5 | 6 |
| coco monoethanolamide | 4 | 4 | 5 | 15 | 5 | 4 | 4 | 4 | 4 | 4 |
| sodium lauryl ether sulfate | 17 | 16 | | | | | 16 | | 16 | |
| magnesium lauryl ether sulfate | | | 17 | 18 | 18 | 16 | | 17 | | 17 |
| lauryl monoethanolamide | 6 | 5 | 6 | 6 | 6 | 5 | 5 | 6 | 5 | 6 |
| sodium acetate | 10 | 9 | 10 | 10 | 10 | 9 | 12 | 12 | 12 | 12 |
| magnesium acetate | 6 | 10 | 4 | | | | | | | |
| MgCL2 | | | | 2 | | | 6 | 4 | | |
| MgSO4 | | | | | 5 | | | | 8 | 5 |
| yellow dye | minor | minor | minor | minor | minor | minor | minor | minor | minor | minor |
| fragrance | minor | minor | minor | minor | minor | minor | minor | minor | minor | minor |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for neutralizing alkyl benzene sulfonic acid to provide alkyl benzene sulfonate, the method comprising steps of:

(a) mixing alkyl benzene sulfonic acid with at least one of alkali metal salt, alkaline earth salt, and mixture thereof in an extruder to provide a mixture, wherein the extruder is operated at a screw speed of at least about 20 rpm, (b) neutralizing the alkyl benzene sulfonic acid to alkyl benzene sulfonate.

2. A method according to claim 1, wherein the alkyl benzene sulfonic acid comprises linear dodecyl benzene sulfonic acid.

3. A method according to claim 1, wherein the step of mixing comprises mixing the alkyl benzene sulfonic acid with a mixture of alkali metal salt and alkaline earth salt.

4. A method according to claim 3, wherein the alkali metal salt comprises sodium metal salt, and the alkaline earth salt comprises magnesium salt.

5. A method according to claim 4, wherein the molar ratio of sodium metal salt to magnesium salt is 3:1 to 1:1.

6. A method according to claim 4, wherein the molar ratio of sodium metal salt to magnesium salt is about 2:1.

7. A method according to claim 1, wherein the mixture is provided at a pressure of between about 5 psig and about 150 psig.

8. A method according to claim 1, wherein the extruder comprises a single screw extruder.

9. A method according to claim 1, wherein the extruder comprises a twin screw extruder.

10. A method according to claim 1, wherein the extruder is operated at a screw speed of between about 20 rpm and about 300 rpm.

11. A method according to claim 1, wherein the extruder is operated at a screw speed of between about 40 rpm and about 150 rpm.

12. A method according to claim 1, wherein the mixture in the extruder is provided at a temperature of between about 50° C. and about 200° C.

13. A method according to claim 1, further comprising a step of:

(a) discharging the alkyl benzene sulfonate at a temperature of at least about 30° C.

14. A method according to claim 1, wherein the mixture in the extruder is provided at a pressure of between about 5 psig and about 6000 psig.

15. A method according to claim 1, further comprising a step of:

(a) discharging the alkyl benzene sulfonate directly into a packaging receptacle.

16. A method according to claim 1, wherein the step of neutralizing occurs during the step of mixing.

17. A method according to claim 1, wherein the steps of mixing and neutralizing occur without the application of external heat to the extruder.

* * * * *